US007895685B2

(12) United States Patent
Vinokur et al.

(10) Patent No.: US 7,895,685 B2
(45) Date of Patent: Mar. 1, 2011

(54) SOAKING BASIN HAVING DISPOSABLE LINER

(75) Inventors: Genya Vinokur, Los Angeles, CA (US); Sasha Vinokur, Los Angeles, CA (US); Michael Vinokur, Los Angeles, CA (US)

(73) Assignee: Footsie Bath LLC, Los Angeles, CA (US)

( * ) Notice: Subject to any disclaimer, the term of this patent is extended or adjusted under 35 U.S.C. 154(b) by 1113 days.

(21) Appl. No.: 11/382,548

(22) Filed: May 10, 2006

(65) Prior Publication Data

US 2007/0056087 A1 Mar. 15, 2007

Related U.S. Application Data

(60) Provisional application No. 60/679,619, filed on May 10, 2005.

(51) Int. Cl.
*A61H 33/00* (2006.01)

(52) U.S. Cl. ..... 4/620; 4/596; 4/583; 4/622

(58) Field of Classification Search ..... 4/622, 621, 4/541.1, 655, 580, 581, 583, DIG. 18, 596, 4/180; 601/156, 157
See application file for complete search history.

(56) References Cited

U.S. PATENT DOCUMENTS

| | | | | |
|---|---|---|---|---|
| 430,195 | A | 6/1890 | Reimers | |
| 2,904,037 | A | 9/1959 | Cassidy | |
| 3,367,325 | A * | 2/1968 | O'Keefe | 601/168 |
| 4,010,498 | A * | 3/1977 | Jablonski | 4/569 |
| 4,513,735 | A | 4/1985 | Friedson et al. | |
| 6,085,367 | A | 7/2000 | Guiste | |
| 6,708,961 | B2 * | 3/2004 | Ferber et al. | 261/122.1 |
| 6,772,800 | B1 | 8/2004 | Garcia | |
| 6,886,191 | B2 | 5/2005 | Zolotnik | |
| 2003/0074730 | A1 * | 4/2003 | Ferber et al. | 4/622 |
| 2005/0188458 | A1 * | 9/2005 | Dickstein | 4/583 |
| 2006/0242760 | A1 | 11/2006 | Chao | |

* cited by examiner

*Primary Examiner* — Gregory L Huson
*Assistant Examiner* — Lauren Heitzer
(74) *Attorney, Agent, or Firm* — Tsircou Law, P.C.

(57) ABSTRACT

A soaking basin is provided having a disposable liner and a base unit. The liner defines an air chamber and a plurality of apertures defined in a floor of the liner. The base unit includes an air blower system connected to the liner such that air is forced out the apertures of the liner into the liquid. The liner can further include a water-soluble coating of soaking additives adhered thereto. In this manner, the liner and the base unit cooperatively provide a therapeutic soak, even in a salon setting, without sacrificing hygienic practices. Moreover, the basin is cost-effective to manufacture and use.

14 Claims, 2 Drawing Sheets

SOAKING BASIN HAVING DISPOSABLE LINER

CROSS REFERENCE TO RELATED APPLICATION

This application claims the benefit of U.S. Provisional Application No. 60/679,619, filed May 10, 2005, which is herein incorporated by reference.

FIELD OF THE INVENTION

The present invention relates generally to soaking basins and, more particularly, to a soaking basin having a disposable liner.

BACKGROUND OF THE INVENTION

While receiving a pedicure or a manicure at beauty salons, clients customarily have their hand and feet soaked in a basin of warm liquid. Oftentimes, the basin is configured to circulate the liquid, e.g., by agitation or forced air. Soaking softens the skin and nails and has many other therapeutic benefits to include stimulating circulation of the blood and otherwise alleviating fatigue. Consequently, soaking is a particularly enjoyable part of having a manicure or pedicure.

In a salon setting, a soaking basin can be used by dozens of clients in a single day. So, hygienic practices regarding use of the basins are an important consideration. It is common and often required, that the basin is emptied and cleaned between uses. However, such repeated cleaning can reduce the life of the basin and can be time consuming. Instead, to cut down on repeated cleanings and yet to promote hygiene, many salons use makeshift liners such as plastic sacks, particularly those commonly used for groceries. Although generally effective, such stacks lack sufficient rigidity to remain in place. Thus, leaking can be problem and, even if properly secured, wet sacks can feel odd against the client's skin.

It should, therefore, be appreciated that there exists a need for a soaking basin having a disposable liner that provides a therapeutic soak and is cost-effective to manufacture. The present invention fulfills this need and others.

SUMMARY OF THE INVENTION

Briefly, and in general terms, a soaking basin is provided having a disposable liner and a base unit. The liner defines an air chamber and a plurality of apertures defined in a floor of the liner. The base unit includes an air blower system connected to the liner such that air is forced out the apertures of the liner into the liquid. In this manner, the liner and the base unit cooperatively provide a therapeutic soak, even in a salon setting, without sacrificing hygienic practices. Moreover, the basin is cost-effective to manufacture and use.

More specifically, in an exemplary embodiment, the base unit includes a base housing and a peripheral wall projecting upwardly therefrom, which combine to define a base cavity for receiving the disposable liner. The liner is configured to nest with the base cavity. The base unit provides structural support to the soaking basin, allowing the liner to be particularly thin, e.g., 0.03-0.20 mm, without sacrificing the stability of the basin.

In a detailed aspect of an exemplary embodiment, the base unit defines an air conduit extending from the base housing up the peripheral wall for connection to the liner at an upper end thereof. The conduit extends above the upper end of the liner. In other words, the conduit extends above the waterline even when the liner is fully filled, thereby inhibiting liquid from traveling down the conduit. A stopper is provided at the connection between the conduit and the liner to maintain an air-tight seal.

In another detailed aspect of an exemplary embodiment, an inhibitor can be provided along the air path between the air blower system and the apertures of the liner. For example, the conduit and the connection point could reside below the maximum waterline of the liner, while having an inhibitor disposed along the air path in which the inhibitor is configured to prevent liquid from passing while allowing air generated by the fan to proceed past.

In yet another detailed aspect of an exemplary embodiment, the heater can also be configured to heat the liquid more directly, e.g., via heating elements disposed about base unit adjacent to the liner. Also, other therapeutic systems such a vibration system can be incorporated into the base unit.

In yet another detailed aspect of an exemplary embodiment, the liner can be provided with water-soluble material coated on an inner surface to provide For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
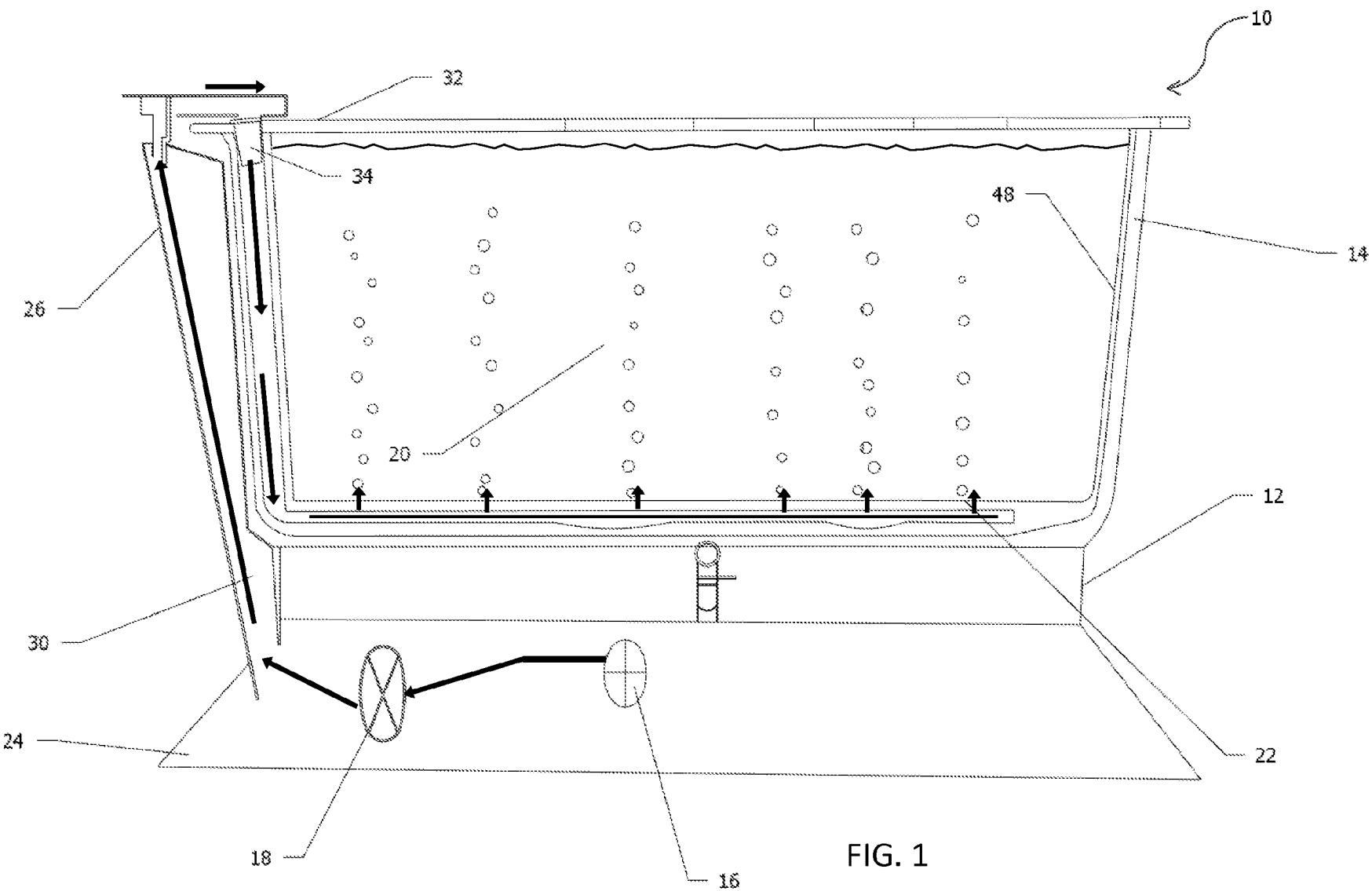
FIG. 1 is side cross-sectional view of a soaking basin having a disposable liner in accordance with the invention, depicting an air blower system configured to generate air bubbles for a therapeutic soak.

Referring now to the drawings, and particularly FIG. 1, there is shown a soaking basin 10 having a base unit 12 and a disposable liner 14 positioned atop the base unit. The liner and the base unit cooperatively provide a therapeutic soak having enhanced liquid movement. To that end, the base unit includes an air blower system, including a fan 16 and a heater 18, to supply heated air to the liner. The heated air then flows through an air chamber 20 defined in the liner and out the apertures 22 of the liner. The apertures are spaced throughout the interior surface of the liner and are sized to create therapeutic bubbles in the soaking basin. In this manner, the basin provides users the assurance of a disposable liner while enjoying a therapeutic soak.

The base unit 12 includes a base housing 24 and a peripheral wall 26 projecting upwardly therefrom, which combine to define a base cavity for receiving the disposable liner. The heater 18 and the fan assembly 16 are mounted within the base housing and are operatively connected to the liner. The heater is configured to heat the air generated by the fan assembly to prevent the air bubbles generated from unduly cooling the liquid held in the liner. The heater can also be configured to heat the liquid more directly, e.g., via heating elements disposed about base unit adjacent to the liner. Also, other therapeutic systems such a vibration system can be incorporated into the base unit, as desired.

The base unit 12 defines an air conduit 30 extending from the base housing up the peripheral wall for connection to the liner 14 at an upper end 32 thereof. A stopper 34 is provided at the connection between the conduit and the liner to maintain an air-tight seal. In the exemplary embodiment, the conduit extends above the upper end of the liner. In other words, the conduit extends above the waterline even when the liner is fully filled, thereby inhibiting liquid from traveling down the conduit without requiring any sort of liquid inhibitor, e.g., one-way valves, along the air path. In other embodiments, a liquid inhibitor can be provided. For example, the conduit and the connection point could reside below the maximum waterline of the liner, while having an inhibitor disposed along the air path, in which the inhibitor is configured to prevent liquid from passing while allowing air generated by the fan to proceed past.

Figure 2:
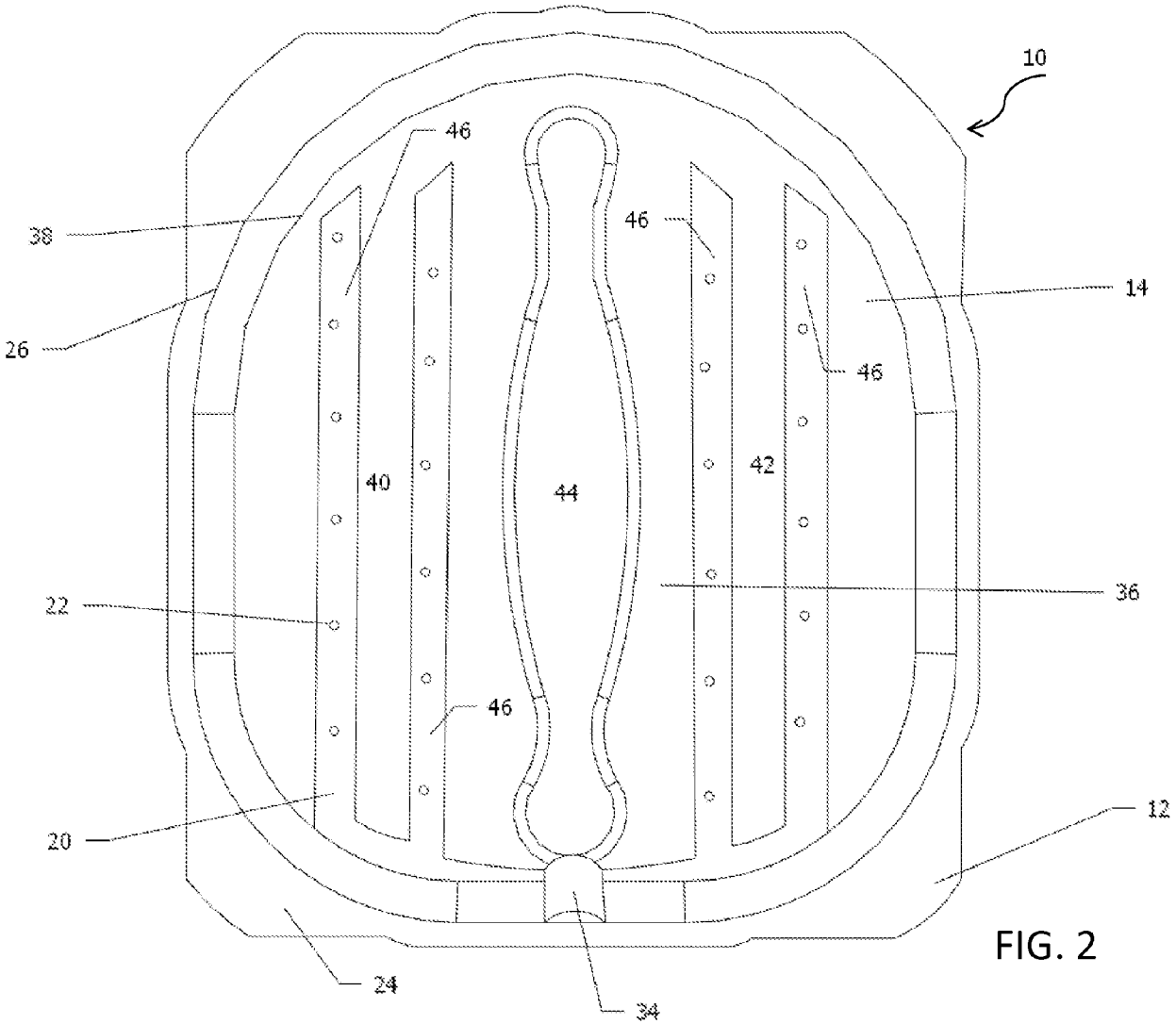
FIG. 2 is a plan view of the soaking basin of FIG. 1, depicting a plurality of apertures defined in a floor of the liner to facilitate injection of air bubbles into the basin.

With reference now to FIG. 2, the liner 14 includes a floor 36 and a peripheral wall 38, circumscribing the floor. The liner is configured to nest within the base cavity. The floor of the liner defines foot areas 40 and 42 positioned on opposite sides of an elongate protrusion 44. The areas are shaped to comfortably accommodate a typical user's left foot and right foot. The air chamber 20 defined by the liner extends down the peripheral wall and into both foot areas. More particularly, the air chamber splits into several branches 46 defined in the floor of the liner in both foot areas. The apertures 22 are spaced along the branches. In the exemplary embodiment, two parallel branches are in each foot area, generally aligned with the corresponding foot such that the resulting bubble will hit the sole of the foot. In other embodiments, the air chamber can be arranged in various different configurations and locations, for example, to achieve different bubble patterns. The floor of the liner further defines a plurality of bumps in both foot areas. The bumps are positioned to provide points of contact against the soles of a user's feet.

Since the liner 14 is intended to be disposed after use, material cost for the liner is an important consideration. The liner is formed of liquid impermeable material such as plastic, e.g., polycarbonate or PET plastic. In the exemplary embodiment, the base unit is configured to provide structural support to the soaking basin, allowing the liner to be particularly thin, e.g., 0.03-0.20 mm, without sacrificing stability.

In an exemplary embodiment, a water-soluble coating 48 can be disposed on an interior surface of the liner 14. For example, the coating can include a combination of soap and skin softener that dissolves when liquid is held in the liner. In this manner, prescribed proportions of additives in the soaking liquid of the basin can be ensured for optimized therapeutic treatment. In an exemplary method of manufacturing, a preformed liner is sprayed with a prescribed solution having desired additives, e.g., soap and skin softener. The sprayed liner is then heated, causing the solution to dehydrate and adhere to the liner. For example, the sprayed liner can be heated at about 135 degrees until the solution sufficiently adheres.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A soaking basin, comprising:

a base unit having a base housing and a peripheral wall projecting upwardly therefrom, the base housing and the peripheral wall combining to define a basin cavity, the base unit having an air blower system including a fan disposed in the base housing and an air conduit extending from the base housing to an upper end of the peripheral wall terminating in a stopper; and a disposable plastic liner formed to have a floor and a peripheral wall extending upwardly from the floor, the liner sized to nest within the basin cavity and configured to hold a soaking solution, the liner defining an air chamber within the floor and the peripheral wall thereof, the air chamber terminating proximate to an upper edge of the liner and configured to couple to the stopper of the air blower system, the air chamber further extending across the floor of the liner and defining a plurality of apertures such that air is blown into the air chamber by air blower system and exits through the apertures into the soaking solution.

2. A soaking basin as defined in claim 1, wherein the liner has a thickness between about 0.03 mm and 0.20 mm.

3. A soaking basin as defined in claim 1, wherein the base unit defines the air conduit for connection to the liner, and the stopper provided for connection between the conduit and the liner to maintain an air-tight seal.

4. A soaking basin as defined in claim 1, the base unit further having an inhibitor provided along the air conduit configured to prevent liquid from passing while allowing air generated by the air blower system to proceed past.

5. A soaking basin as defined in claim 1, the air blower system having a heater to heat the air provided to the liner.

6. A soaking basin as defined in claim 1, the base unit further having a heater having heating elements disposed unit adjacent to the liner to heat the liquid held therein.

7. A soaking basin as defined in claim 1, the base unit further having a vibration system configured to vibrate the liquid held in the liner.

8. A soaking basin as defined in claim 1, the liner further having a water-soluble coating of soaking liquid additives adhered to an interior surface thereof.

9. A soaking basin as defined in claim 8, wherein the coating includes soap and skin softener.

10. A soaking basin, comprising:

a base unit having a base housing and a peripheral wall projecting upwardly therefrom, the base housing and the peripheral wall combining to define a basin cavity, the base unit having an air blower system including a fan disposed in the base housing and an air conduit extending from the base housing to an upper end of the peripheral wall terminating in a stopper; and a disposable plastic liner having a thickness between about 0.03 mm and 0.20 mm, the liner formed to have a floor and a peripheral wall extending upwardly from the floor, the liner sized to nest within the basin cavity and configured to hold a soaking solution, the liner defining an air chamber within the floor and the peripheral wall thereof, the air chamber terminating proximate to an upper edge of the peripheral wall of the liner and configured to couple to the stopper of the air blower system, the air chamber further extending across the floor of the liner and defining a plurality of apertures such that air is blown into the air chamber by the air blower system and exits through the apertures into the soaking solution; wherein the floor of the liner defines two foot areas positioned on opposite sides of an elongate protrusion.

11. A soaking basin as defined in claim 10, wherein the air chamber defined by the liner extends into both foot areas.

12. A soaking basin as defined in claim 11, wherein the air chamber includes a plurality of branches defined in the floor of the liner in both foot areas, and the apertures are spaced along the branches.

13. A soaking basin as defined in claim 10, wherein the base unit defines the air conduit for connection to the liner, and the stopper provided for connection between the conduit and the liner to maintain an air-tight seal.

14. A soaking basin as defined in claim 10, the base unit further having an inhibitor provided along the air conduit configured to prevent liquid from passing while allowing air generated by the air blower system to proceed past.

* * * * *